US008651536B2

(12) United States Patent
Kurebayashi et al.

(10) Patent No.: US 8,651,536 B2
(45) Date of Patent: Feb. 18, 2014

(54) DOOR LOCK DEVICE

(75) Inventors: Hayato Kurebayashi, Fujisawa (JP); Ryota Kadonishi, Fujisawa (JP)

(73) Assignee: Shiroki Corporation, Kanagawa (JP)

( * ) Notice: Subject to any disclaimer, the term of this patent is extended or adjusted under 35 U.S.C. 154(b) by 483 days.

(21) Appl. No.: 12/997,277

(22) PCT Filed: Jun. 5, 2009

(86) PCT No.: PCT/JP2009/060341

§ 371 (c)(1),
(2), (4) Date: Dec. 10, 2010

(87) PCT Pub. No.: WO2009/151008

PCT Pub. Date: Dec. 17, 2009

(65) Prior Publication Data

US 2011/0084504 A1 Apr. 14, 2011

(30) Foreign Application Priority Data

Jun. 11, 2008 (JP) ..... 2008-153101

(51) Int. Cl.
*E05C 3/06* (2006.01)
*E05C 3/16* (2006.01)

(52) U.S. Cl.
USPC ..... 292/201; 292/216

(58) Field of Classification Search
USPC ..... 292/201, 216, DIG. 23
See application file for complete search history.

(56) References Cited

U.S. PATENT DOCUMENTS 4,858,117 A 8/1989 DiChiara et al.
5,035,454 A * 7/1991 Fukumoto et al. ..... 292/337
5,618,068 A * 4/1997 Mitsui et al. ..... 292/201
5,887,466 A * 3/1999 Yoshizawa ..... 70/257
5,938,252 A 8/1999 Uemura et al.
2008/0129058 A1 6/2008 Deblock
2012/0248796 A1 * 10/2012 Kurebayashi ..... 292/201

FOREIGN PATENT DOCUMENTS

JP 5 78858 10/1993
JP 11 236776 8/1999
JP 3160553 B2 2/2001
JP 2006 249872 9/2006
JP 2006-328708 A 12/2006
JP 2008-519184 A 6/2008

OTHER PUBLICATIONS

International Search Report of PCT/JP2009/060341 (Jul. 7, 2009).
Mitsui Mining & Smelting Co Ltd., "Door latch," Patent Abstracts of Japan, Publication Date: Sep. 21, 2006; English Abstract of JP-2006 249872.
ASMO Co Ltd Shiroki Corp., "Locking/unlocking device for door body," Patent Abstracts of Japan, Publication Date: Aug. 31, 1999; English Abstract of JP-11-236776.

* cited by examiner

*Primary Examiner* — Carlos Lugo
(74) *Attorney, Agent, or Firm* — Millen, White, Zelano & Branigan, P.C.

(57) ABSTRACT

A door lock device includes a hook rotatable supported on a base plate; a latch supported on the base plate and rotatable between a latching position, engageable with the hook and an unlatching position not engaged with the hook; a latch controller which prevents the hook from rotating from the striker holding position to the striker releasing position, and makes the latch return to the latching position upon the hook reaching the striker releasing position after engagement between the latch and the hook is released by rotating the latch to the unlatching position from the latching position when the latch controller performs a door opening operation from the door fully-closed state; and a detector which detects that the door is open by referring to the returning operation of the latch to the latching position from the unlatching position that is caused by the latch controller.

7 Claims, 12 Drawing Sheets

DOOR LOCK DEVICE

FIELD OF THE INVENTION

The present invention relates to a door lock device for locking and unlocking a door installed in a vehicle.

BACKGROUND OF THE INVENTION

Among known door lock devices, a type of door lock device (a so-called door closer) that is capable of automatically fully-closing a door by a motor-operated driving mechanism, having a drive source such as a motor, when the door is being manually closed is known in the art. In this type of door lock device, upon a hook that includes a striker holding portion being rotated to the striker holding position (in the striker draw-in direction) when the door is closed, a latch (pawl) engages with the hook to thereby prevent the hook from rotating in the striker releasing direction, so that the door enters into a locked state. When the door is opened, rotating the latch in a direction (unlatching direction) to make the latch disengaged from the hook causes the hook having been biased to rotate in the striker releasing direction to rotate to thereby release the holding of the striker, thus allowing the door to be opened.

PRIOR ART

Patent Documents

Patent Document 1: Japanese Unexamined Patent Publication No. 2006-249872

Patent Document 2: Japanese Unexamined Patent Publication No. H11-236776

SUMMARY OF THE INVENTION

Problems to be Solved by the Invention

In the door lock device such as described above, a draw-in commencement state in which a striker draw-in operation commences when the door is closed, fully-latched state corresponding to the door fully-closed state and an open state corresponding to the door-open state need to be detected. These states can be detected by referring to the position of a movable member of the door lock device; for instance, the moment in time at which the hook rotates to the striker releasing position is detected as the open state. However, on the base plate to which the elements of the door lock device are installed, it is difficult to secure an installation space for a detector for detecting motion of the hook around the hook, so that it is sometimes the case that such a detector is installed onto a different part from the base plate. Accordingly, there has been a problem with it being troublesome to make a sensor accuracy adjustment so that the detector can detect motion of the hook with precision. In addition, a door lock device in the form of a unit that includes the detector has been desired as a configuration for product delivery.

The present invention has been devised in view of the above described problems, and an object of the present invention is to provide a door lock device which can detect a door-open state with high precision with no constraints on the space around the hook, and which is easy to setup when the door lock device is installed.

Means for Solving the Problem

The present invention has been accomplished by paying attention to the detection of an operating state of the door lock device by referring to the operation of the latch instead of the hook. Specifically, the present invention is characterized in that it includes a door lock device for holding a door in a fully-closed state, the door being capable of being opened and closed relative to a vehicle body. The door lock device including a base plate and a striker which are installed to one and the other of the door and the vehicle body; a hook which is supported by the base plate to be rotatable between a striker holding position for holding the striker and a striker releasing position for releasing the striker, the hook being biased toward the striker releasing position; a latch which is supported by the base plate to be rotatable between a latching position at which the latch advances onto a rotating path of an engaging portion provided on the hook and an unlatching position at which the latch withdraws from the rotating path of the engaging portion of the hook; a latch controller which holds the latch in the latching position in each of a door-open state in which the hook is positioned in the striker releasing position and a door fully-closed state in which the hook is positioned in the striker holding position; prevents the hook from rotating toward the striker releasing position by engagement between the engaging portion of the hook and the latch in the door fully-closed state; and, when the latch controller performs a door opening operation from the door fully-closed state, makes the latch return to the latching position upon the hook reaching the striker releasing position after engagement between the latch and the hook has been released by causing the latch to rotate toward the unlatching position from the latching position; and a detector which, during the door opening operation, detects that the door is open by referring to the returning operation of the latch to the latching position from the unlatching position that was performed by the latch controller.

More specifically, the door lock device is provided, including a closing lever which is supported by the base plate thereon to be rotatable coaxially with the hook and rotates between a draw-in position, at which the closing lever is positioned toward the striker holding position of the hook, and a draw-in releasing position, at which the closing lever is positioned toward the striker releasing position of the hook; a closing lever biaser which biases the closing lever toward the draw-in releasing position; an opening lever which includes an arm portion that generally overlays the latch, is rotatably supported by the base plate thereon, and rotates between an opening position at which the arm portion is displaced toward the unlatching position of the latch and a closing position at which the arm portion is displaced toward the latching position of the latch; and a motor-operated driving mechanism, provided with a motor which rotates the closing lever to the draw-in position by a forward rotation of the motor and rotates the opening lever to the opening position by a reverse rotation of the motor. The latch controller includes an interlinking lever which is pivoted on the closing lever and rotatable between a coupling position at which the closing lever and the hook are coupled so as to integrally operate via the interlinking lever and a coupling disengaging position at which the coupling state between the closing lever and the hook is released by the interlinking lever to allow the closing lever and the hook to rotate relative to each other; a control hole which is formed in the arm portion of the opening lever, allows a control projection which is provided on the interlinking lever to engage in the control hole, and transmits a force to the control projection by a rotation of the opening lever from the closing position to the opening position to make the interlinking lever move from the coupling position to the coupling disengaging position; a latch biaser which biases the latch toward the latching position; an interlinking-lever linkup portion which is provided on the latch and receives a force acting in a direction toward the unlatching position by a rotation of the interlinking lever from the coupling position to the coupling disengaging position; and latch holders which are provided between the hook and the latch, contact each other to hold the latch in the unlatching position against the latch biaser when the hook is positioned at some point between the striker holding position and the striker releasing position, and are released from contact with each other to allow the latch to move to the latching position when the hook is positioned in the striker holding position and when the hook is positioned in the striker releasing position. When the opening lever is rotated from the closing position to the opening position in the door fully-closed state, the interlinking lever is rotated from the coupling position to the coupling disengaging position by a projection operating surface of the opening lever in the control hole, and after the latch is rotated from the latching position to the unlatching position via the interlinking-lever linkup portion, the interlinking lever retracts from an interlinked position with respect to the latch via a rotation of the closing lever from the draw-in position to the draw-in releasing position by a biasing force of the closing lever biaser; the hook rotates from the striker holding position to the striker releasing position by the movement of the latch to the unlatching position, and holds the latch in the unlatching position via the latch holder after an operation of the latch performed by the interlinking lever is canceled; and, upon the hook reaching the striker releasing position, the holding of the latch in the unlatching position by the latch holder is canceled, so that the latch rotates to the latching position by a biasing force of the latch biaser.

In addition, the door lock device is provided, including an opening lever biaser which biases the opening lever toward the closing position, and opening lever holders which are provided between the hook and the opening lever, and prevent the opening lever from rotating toward the closing position from the opening position when the hook is positioned in the striker releasing position. When the door is closed from an open state thereof, upon the hook reaching a draw-in commencement position at some point during rotation of the hook from the striker releasing position toward the striker holding position, the holding state of the opening lever by the opening lever holders is canceled so that the opening lever rotates from the opening position to the closing position by a biasing force of the opening lever biaser while the interlinking lever rotates from the coupling disengaging position to the coupling position by the biasing force of the closing lever biaser to be coupled to the hook.

The specific shape of the control hole of the opening lever in this case is determined in the following manner. Firstly, the projection operating surface of the opening lever in the control hole includes a circular arc surface which is formed along a moving path of the control projection that accompanies rotation of the closing lever when the opening lever is in the opening position and also when the interlinking lever is in the coupling disengaging position. The control hole of the opening lever includes an opposed guide surface formed from a circular arc surface which is opposed to the projection operating surface and formed along a moving path of the control projection that accompanies rotation of the closing lever when the opening lever is in the closing position and also when the interlinking lever is in the coupling position. The control hole is an elongated hole which gradually increases a distance between the projection operating surface and the opposed guide surface in a direction toward the draw-in releasing position from the draw-in position of the closing lever.

When the door is opened from the fully-closed state thereof, the control projection of the interlinking lever held in the coupling disengaging position moves along the projection operating surface in the control hole of the opening lever positioned in the opening position, and the closing lever is locked in the draw-in releasing position by engagement of the control projection with an end of the control hole on a wide-width side thereof. When the door is closed from the open state thereof, the rotation of the opening lever from the opening position to the closing position upon the hook reaching the draw-in commencement position from the striker releasing position causes the control projection of the interlinking lever to move from the projection operating surface side toward the opposed guide surface side, and subsequently a rotation of the closing lever from the draw-in releasing position to the draw-in position causes the control projection of the interlinking lever to move toward an end of the control hole on a narrow-width side thereof along the opposed guide surface of the opening lever held in the closing position.

The detector can include a first switch for detecting the latching position and the unlatching position of the latch, and a second switch for detecting the opening position and the closing position of the opening lever, wherein the detector detects the door-open state from a combination of the opening position of the opening lever and the latching position of the latch, detects the door fully-closed state from a combination of the closing position of the opening lever and the latching position of the latch, and wherein the detector detects the draw-in commencement position of the hook from a combination of the closing position of the opening lever and unlatching position of the latch.

Effects of the Invention

According to the present invention, when the door opening operation is performed, it is detected that the door is open by a returning operation of the latch to the latching position upon the hook reaching the striker releasing position, and accordingly, a door-opening detecting operation can be performed with high precision with no need for space around the hook. In addition, unitization of the door lock device that includes the detector becomes possible, which is advantageous to productivity and production cost.

EMBODIMENT

Figure 1:
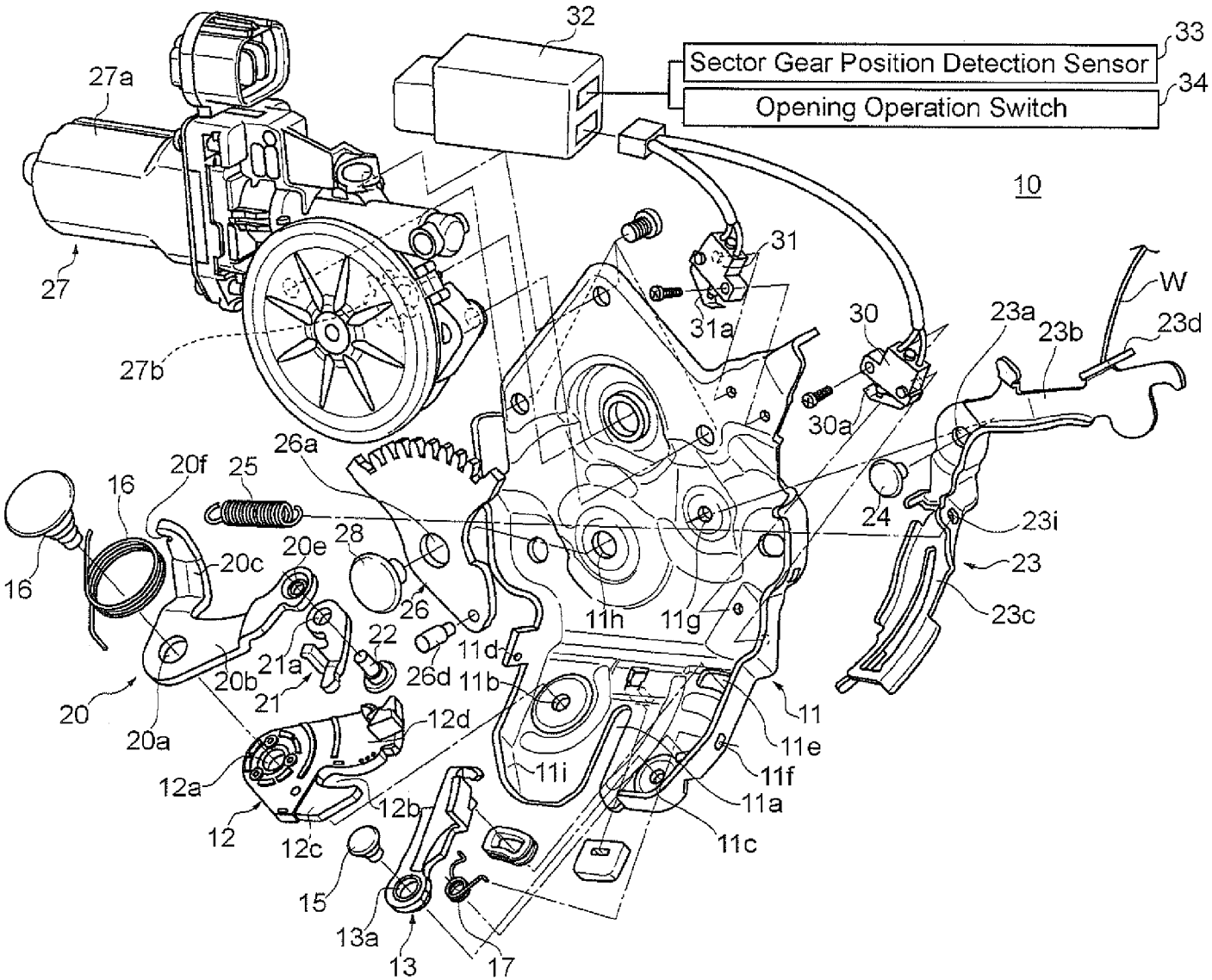
FIG. 1 is an exploded perspective view of a door lock device according to the present invention.

A door lock device according to the present invention will be described below based on the accompanying drawings. The door lock device (door closer) 10 shown in the drawings is installed on a trunk door not shown in the drawings, while a striker S (FIGS. 7 through 9) which is engaged with and disengaged from the door lock device 10 is installed on a vehicle body that supports the trunk door in a manner to allow the trunk door to be opened and closed. In this connection, it is possible to reverse the positional relationship between the door lock device 10 and the striker S.

As shown in FIG. 1, the door lock device 10 is provided with a base plate 11 which is fixedly mounted to the trunk door. A striker entry groove 11*a* into which the striker S can enter is formed in the base plate 11, and pivots 14 and 15 are fixed to pivot support holes 11*b* and 11*c* positioned on both sides of the striker entry groove 11*a*, respectively. The pivot 14 is inserted into a pivotal hole 12*a* formed in a hook 12, and the hook 12 is supported by the pivot 14 to be rotatable about the pivot 14. The pivot 15 is inserted into a pivotal hole 13*a* formed in a latch 13, and the latch 13 is supported by the pivot 15 to be rotatable about the pivot 15.

Figure 2:
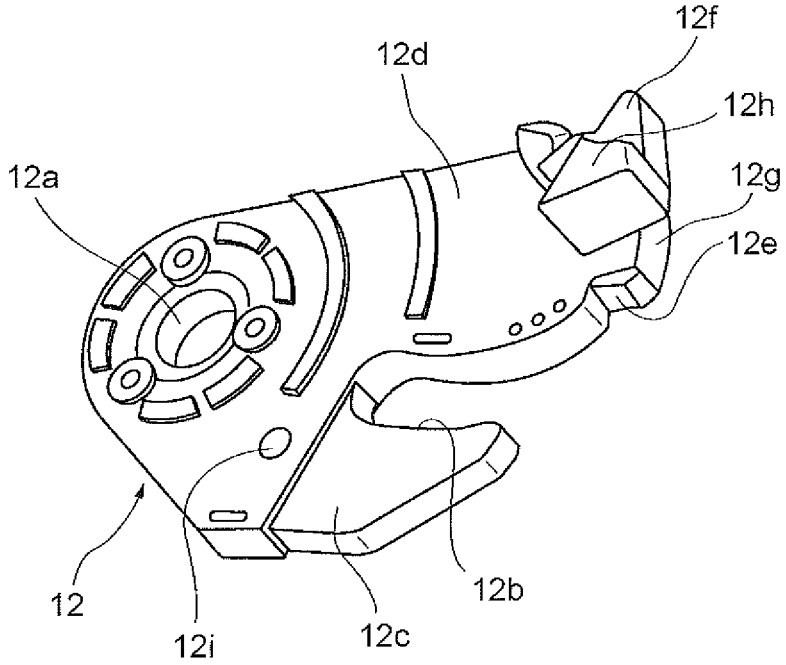
FIG. 2 is a perspective view of a hook of the door lock device.

As shown in FIG. 2, the hook 12 is provided with a striker holding groove 12*b* elongated in a substantially radial direction about the pivotal hole 12*a*, and a first leg portion 12*c* and a second leg portion 12*d* which are positioned on both sides of the striker holding groove 12*b*, respectively. The hook 12 is provided, in the vicinity of an end of the second leg portion 12*d* on a side thereof which faces the striker holding groove 12*b*, with a latch-engaging stepped portion (engaging portion) 12*e*, and is provided in the vicinity of the end of the second leg portion 12*d* on the opposite side thereof with a latch pressure projection (latch controller) 12*f*. In addition, the end edge of the second leg portion 12*d*, which connects the latch-engaging stepped portion 12*e* and the latch pressure projection 12*f* to each other, is formed into a convex-shaped circular arc surface (latch controller/latch holder) 12*g*. Additionally, a coupling projection (opening lever holder) 12*h* is formed on the second leg portion 12*d* to project in a direction away from the base plate 11. The hook 12 is rotatable between a striker releasing position shown in FIG. 7 and a striker holding position shown in FIG. 9 and biased to rotate toward the striker releasing position (clockwise direction with respect to FIGS. 7 through 9) by a torsion spring 16. The torsion spring 16 is provided with a coiled portion which surrounds the pivot 14 and a pair of spring ends which are engaged with a spring hooking hole 12*i* of the hook 12 and a spring hooking hole 11*d* of the base plate 11, respectively.

Figure 3:
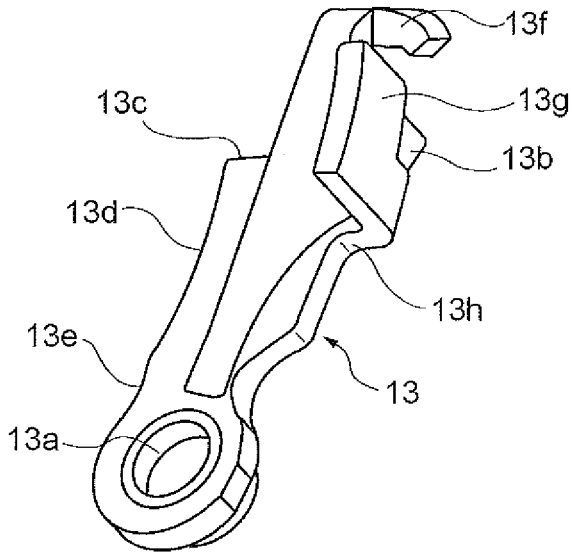
FIG. 3 is a perspective view of a latch of the door lock device.

As shown in FIG. 3, the latch 13 is provided with a guide projection 13*b* which is engaged with a latch guide groove 11*e* formed in the base plate 11 to be freely slidable thereon. The latch 13 is provided on a side thereof facing the hook 12 with a rotation-restriction stepped portion 13*c* that is engageable with the latch-engaging stepped portion 12*e*. A concave-shaped circular arc surface (latch controller/latch holder) 13*d* which corresponds to the convex-shaped circular arc surface 12*g* is formed on a side of the latch 13 which is continuous with the rotation-restriction stepped portion 13*c*, and a smoothly-stepped portion (latch controller) 13*e* is formed on a portion of the concave-shaped circular arc surface 13*d* in the vicinity of the base end of the latch 13 toward the pivotal hole 13*a*. Additionally, the latch 13 is provided, in the vicinity of the end thereof that is distant from the pivotal hole 13*a*, with a switch operating piece 13*f*, and is provided with a pressed piece (latch controller/interlinking-lever linkup portion) 13*g* on the opposite side of the latch 13 from the concave-shaped circular arc surface 13*d*. The latch 13 is rotatable between a latching position (FIGS. 7 and 9) in which the rotation-restriction stepped portion 13*c* is positioned close to the hook 12 on a moving path of the latch-engaging stepped portion 12*e* thereof (in which the rotation-restriction stepped portion 13*c* is engageable with the latch-engaging stepped portion 12*e*) and an unlatching position (FIG. 8) in which the rotation-restriction stepped portion 13*c* is retracted from a position on the moving path of the latch-engaging stepped portion 12*e* (in which the rotation-restriction stepped portion 13*c* is not engageable with the latch-engaging stepped portion 12*e*), and is biased to rotate toward the latching position (in the counterclockwise direction with respect to FIGS. 7 through 9) by a torsion spring (latch biaser) 17. The torsion spring 17 is provided with a coiled portion which surrounds the pivot 15 and a pair of spring ends which are engaged with a spring hooking portion 13*h* of the latch 13 and a spring hooking hole 11*f* of the base plate 11, respectively.

Figure 4:
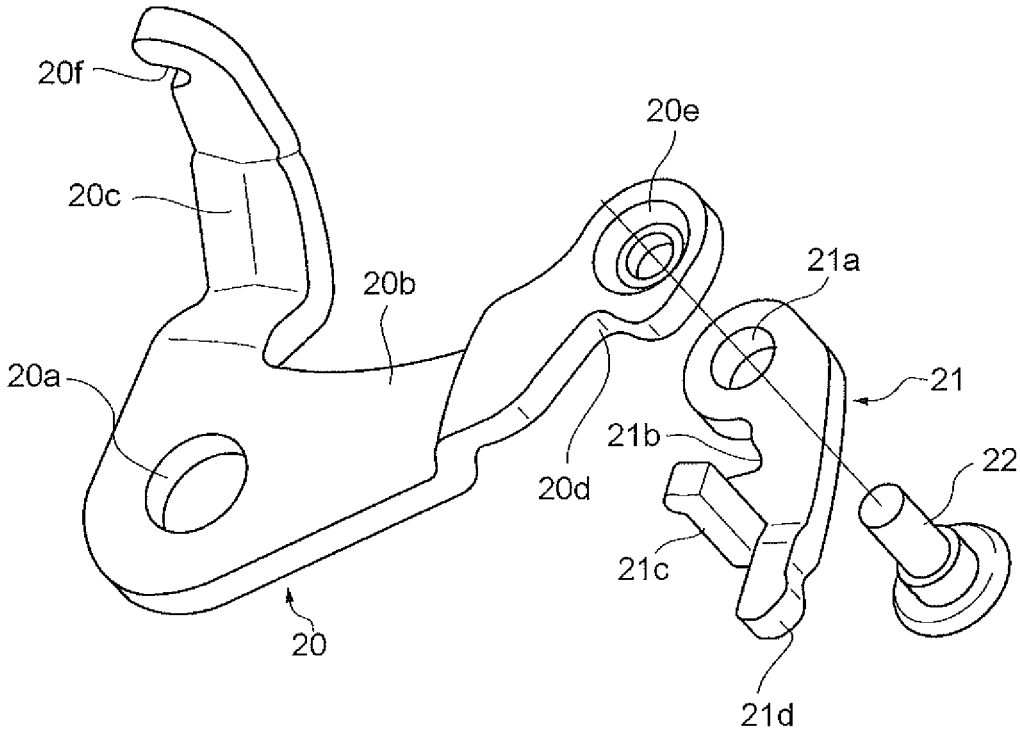
FIG. 4 is a perspective view of a closing lever and an interlinking lever of the door lock device.

The pivot 14 is also inserted into a pivotal hole 20*a* of a closing lever 20, and the closing lever 20 is supported by the pivot 14 to be rotatable independently about the pivot 14 relative to the hook 12. As shown in FIG. 4, the closing lever 20 is L-shaped, has a first arm 20*b* and a second arm 20*c* which extend radially about the pivotal hole 20*a*, and is rotatable between a draw-in releasing position (FIGS. 7 and 8) in which the closing lever 20 is positioned toward the striker releasing position of the hook 12, which rotates coaxially with the closing lever 20, and a draw-in position (FIG. 9) in which the closing lever 20 is positioned toward the striker holding position of the hook 12.

A recess 20*d* with which the coupling projection 12*h* of the hook 12 can come into contact and a pivot support hole 20*e* in which a pivot 22 is inserted to be supported thereby are formed on the first arm 20*b* of the closing lever 20 in the vicinity of the end of the first arm 20*b*. The pivot 22 is inserted into a pivotal hole 21*a* of an interlinking lever (latch controller) 21, and the interlinking lever 21 is pivoted on the closing lever 20 to be rotatable about, the pivot 22. As shown in FIG. 4, the interlinking lever 21 is provided on a side thereof with a coupling recess 21*b* having a shape corresponding to the shape of the coupling projection 12*h*, and is rotatable between a coupling position (in which the interlinking lever 21 is engageable with the coupling projection 12*h*) (FIGS. 8 and 9) in which the coupling recess 21*b* is positioned on a moving path of the coupling projection 12*h* of the hook 12 and a coupling disengaging position (in which the interlinking lever 21 is not engaged with the coupling projection 12*h*) (FIG. 7) in which the coupling recess 21*b* is retracted from the moving path of the coupling projection 12*h* of the hook 12. The interlinking lever 21 is further provided in the vicinity of the coupling recess 21*b* with a control projection 21*c* which projects in a direction away from the base plate 11, and is provided with a latch pressure projection 21*d* at the end of the interlinking lever 21 on the opposite side from the base end thereof including the pivotal hole 21*a*.

Figure 5:
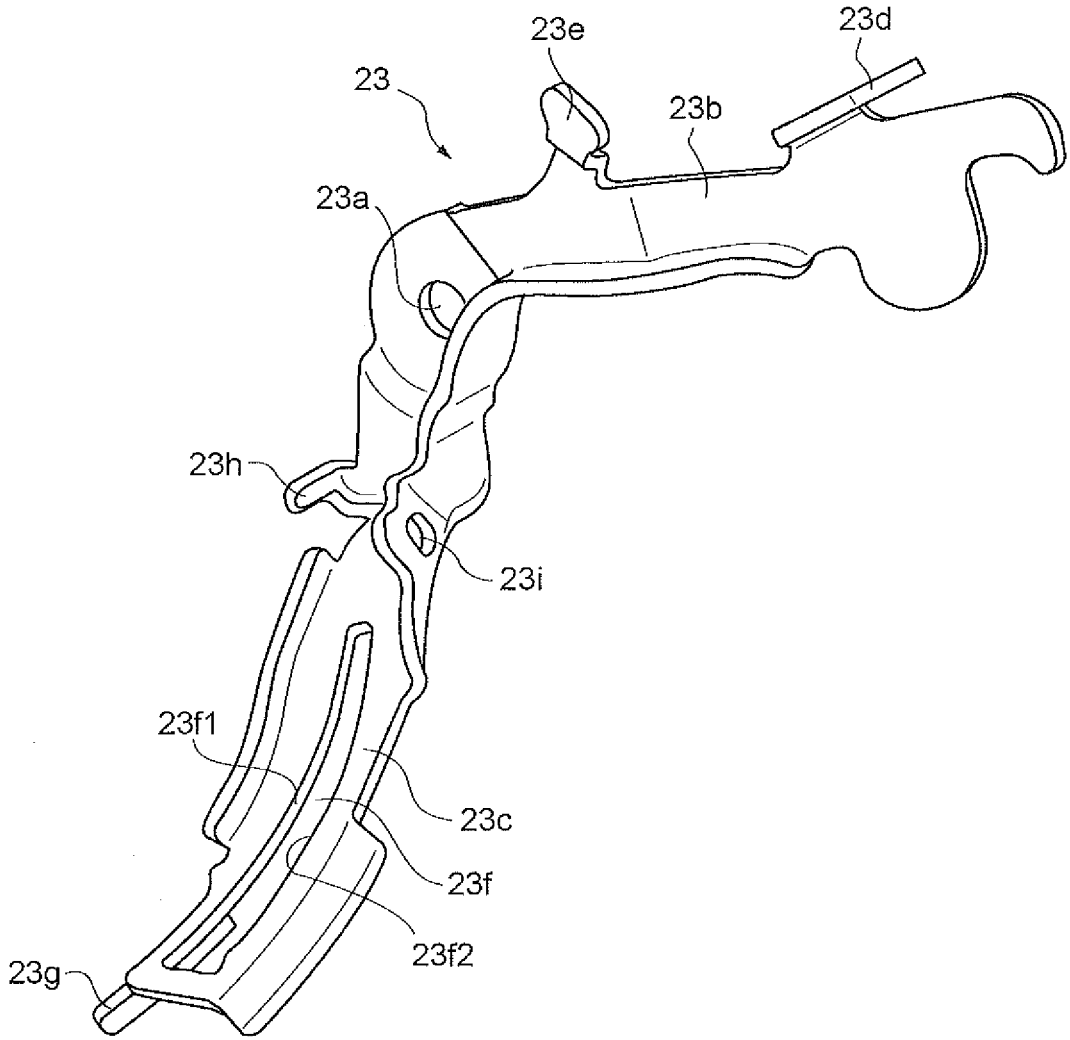
FIG. 5 is a perspective view of an opening lever of the door lock device.
Figure 6:
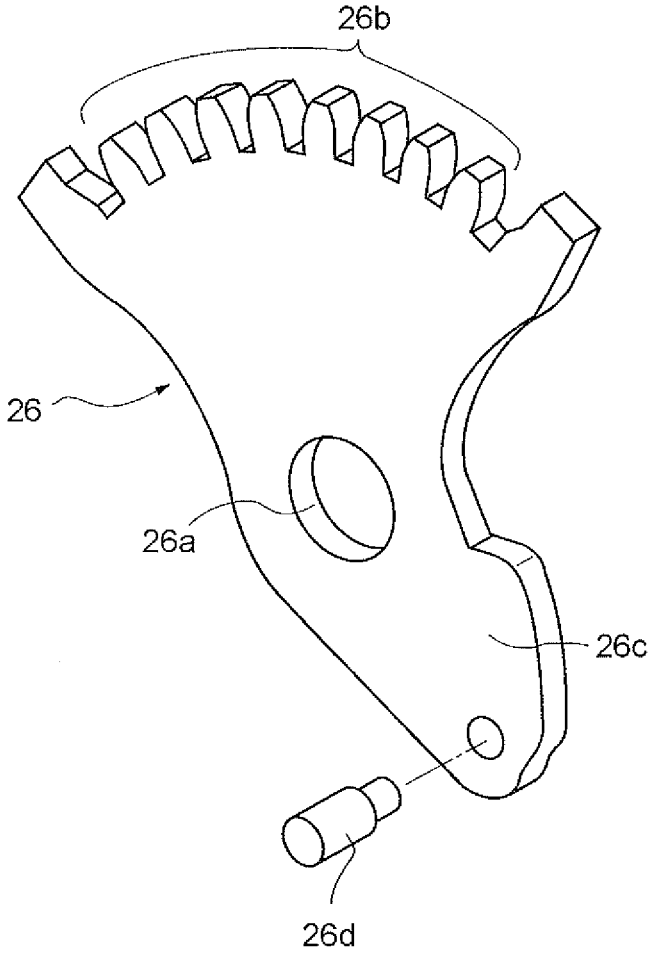
FIG. 6 is a perspective view of a sector gear of the door lock device.
Figure 7:
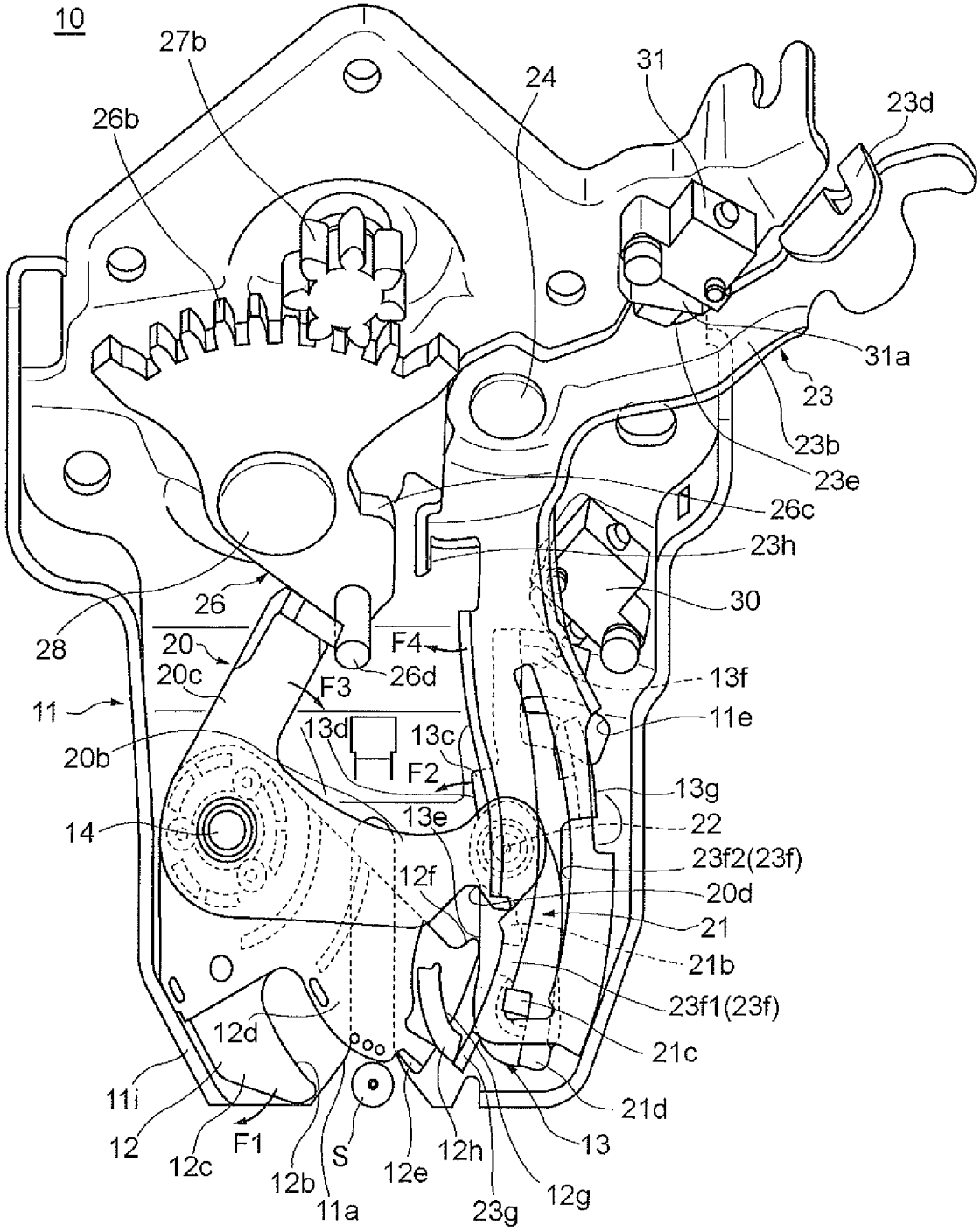
FIG. 7 is a plan view of the door lock device.
Figure 8:
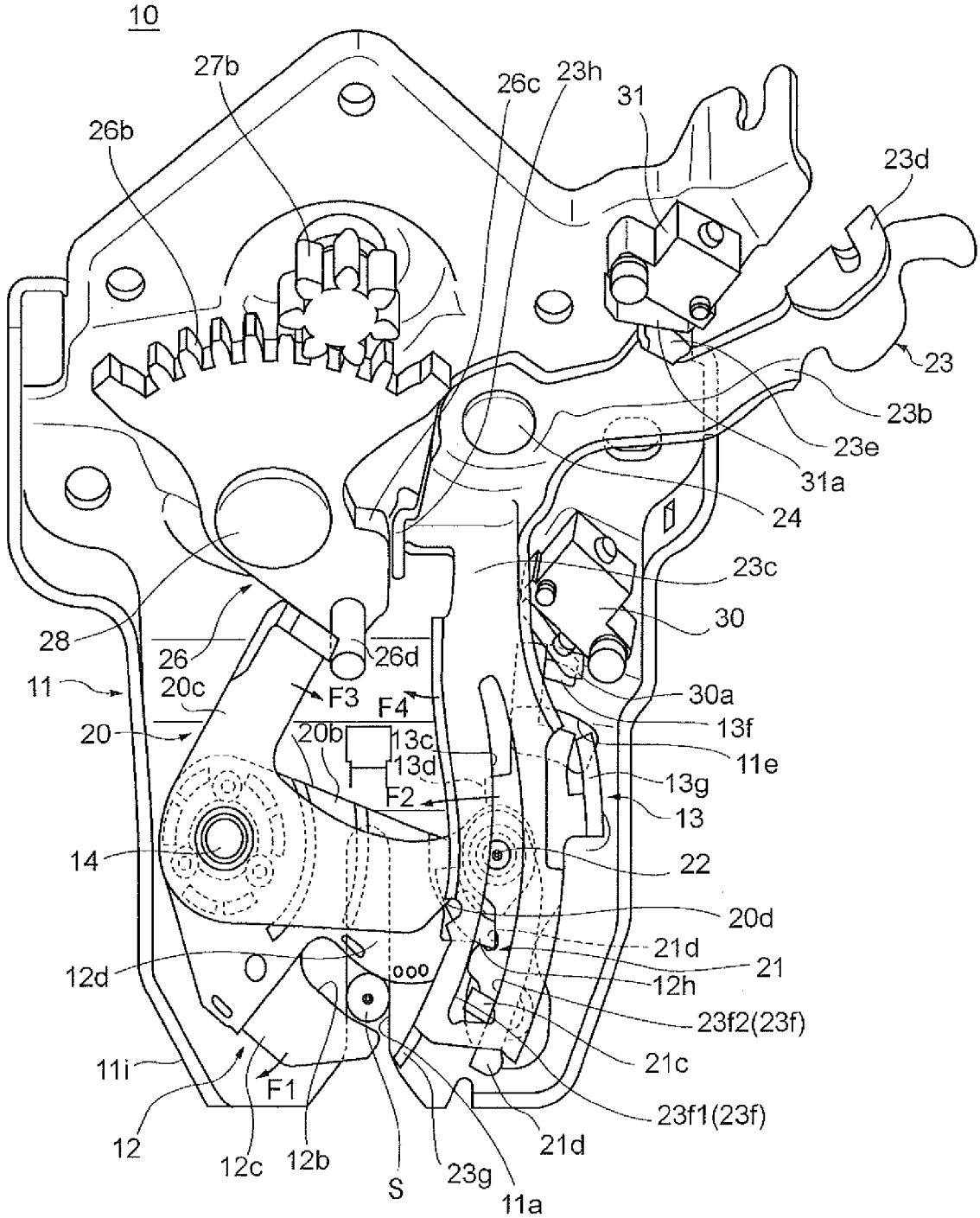
FIG. 8 is a plan view of the door lock device in a half-latched state.
Figure 9:
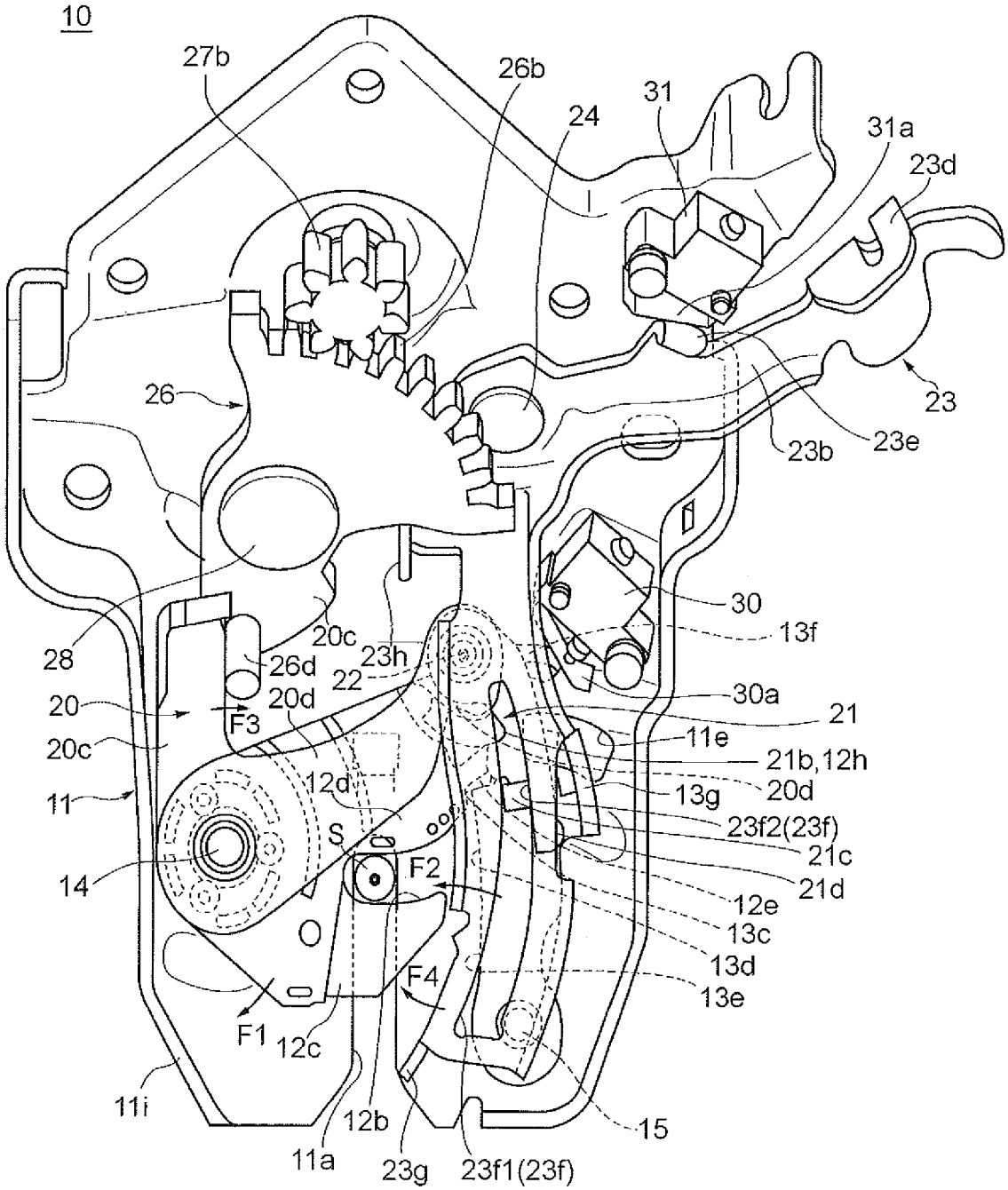
FIG. 9 is a plan view of the door lock device in a state where the operation to a fully-latched state has been completed.

A pivot 24 is fixed to a pivot support hole 11*g* of the base plate 11, and a pivotal hole 23*a* formed in an opening lever 23 is rotatably fitted on the pivot 24. As shown in FIG. 5, the opening lever 23 is provided with a first arm 23*b* and a second arm (arm portion) 23*c* which extend in different directions with the pivotal hole 23*a* as the center. The opening lever 23 is provided in the vicinity of an end of the first arm 23*b* with a wire hooking portion 23*d* to which an opening operation wire W (FIG. 1) is connected, and provided at a midpoint between the pivotal hole 23*a* and the wire hooking portion 23*d* with a switch operating piece 23*e*. The opening operation wire W can be manually pulled by either one of a key apparatus and an emergency release handle not shown in the drawings. The second arm 23*c* is positioned to generally overlay the latch 13 as viewed in plan view as shown in FIGS. 7 through 9, and is provided with an interlinking-lever control hole (latch controller) 23*f* in which the control projection 21*c* of the interlinking lever 21 is inserted, a rotation restriction wall (opening lever holder) 23*g* that is capable of coming in contact with the coupling projection 12*h* of the hook 12, and a gear contact portion 23*h* which faces a sector gear 26, which will be discussed later. The interlinking-lever control hole 23*f* is an elongated hole having a circular arc shape which gradually increases the width thereof in the direction toward the end of the second arm 23*c* (in the direction toward the draw-in releasing position of the closing lever 20) from the side that is close to the pivotal hole 23*a* (from the draw-in position side of the closing lever 20), and the interlinking-lever control hole 23*f* is provided with an inner arc surface (projection operating surface) 23*f*1 and an outer arc surface (opposed guide surface) 23*f*2, the axes of which are mutually different. The opening lever 23 allows the second arm 23*c* thereof, which has the interlinking-lever control hole 23*f*, to rotate between a closing position (FIGS. 8 and 9) in which the second arm 23*c* is displaced toward the latching position of the latch 13 and an opening position (FIG. 7) in which the second arm 23*c* is displaced toward the unlatching position of the latch 13.

An extension spring (closing lever biaser/opening lever biaser) 25 is stretched and installed between a spring hook 20*f* formed on the second arm 20*c* of the closing lever 20 and a spring hook 23*i* formed on the second arm 23*c* of the opening lever 23. The closing lever 20 is biased to rotate toward the aforementioned draw-in releasing position (clockwise direction with respect to FIGS. 7 and 9) by the extension spring 25, while the opening lever 23 is biased to rotate toward the aforementioned closing position (clockwise direction with respect to FIGS. 7 and 9) by the extension spring 25.

A pivot 28 is fixed to a pivotal hole 11*h* of the base plate 11, and a pivotal hole 26*a* of the sector gear 26 is rotatably fitted on the pivot 28. The sector gear 26 is provided with a gear portion 26*b* which is formed on the outer edge of a sector portion about the pivotal hole 26*a*, and an opening lever operating piece 26*c* which can come in contact with the gear contact portion 23*h* of the opening lever 23. The sector gear 26 is provided in the vicinity of the opening lever operating piece 26*c* with a closing lever operating pin 26*d* that is capable of engaging with the second arm 20*c* of the closing lever 20. A motor unit 27 fixed on the base plate 11 is provided with a pinion 27*b* which is driven to rotate forward and reverse by a motor 27*a*, and the pinion 27*b* is engaged with the gear portion 26*b*. The motor unit 27 and the sector gear 26 constitute a motor-operated driving mechanism.

A latch detection switch (detector/first switch) and an opening lever detection switch (detector/second switch) 31 are mounted on the base plate 11. The latch detection switch 30 is a switch which can be pressed by the switch operating piece 13*f* that is provided on the latch 13, and the opening lever detection switch 31 is a switch which can be pressed by the switch operating piece 23*e* that is provided on the opening lever 23. More specifically, the latch detection switch 30 is in a switch-OFF state in which the switch operating piece 13*f* is spaced from a switch leaf 30*a* when the latch 13 is in the latching position shown in FIGS. 7 and 9, and the switch operating piece 13*f* presses the switch leaf 30*a* to thereby turn ON the latch detection switch 30 upon the latch 13 being rotated to the unlatching position shown in FIG. 8. In addition, the opening lever detection switch 31 is in a switch-OFF state in which the switch operating piece 23*e* is spaced from a switch leaf 31*a* when the opening lever 23 is in the closing position shown in FIGS. 8 and 9, and the switch operating piece 23*e* presses the switch leaf 31*a* to thereby turn ON the opening lever detection switch 31 upon the opening lever 23 being rotated to the opening position shown in FIG. 7. The ON/OFF states of the latch detection switch 30 and the opening lever detection switch 31 are input to an electronic control unit (ECU) 32, and the electronic control unit 32 controls the operation of the motor unit 27 in a manner which will be discussed later.

The door lock device 10 is provided with a sector gear position detection sensor 33 (FIG. 1) for detecting an initial position of the sector gear 26 and an opening operation switch 34 (FIG. 1) for performing a motor-driven opening operation. The sector gear position detection sensor 33 is configured from a Hall IC provided inside the motor unit 27 and shown conceptually outside of the motor unit 27 for the purpose of illustration.

Figure 10:
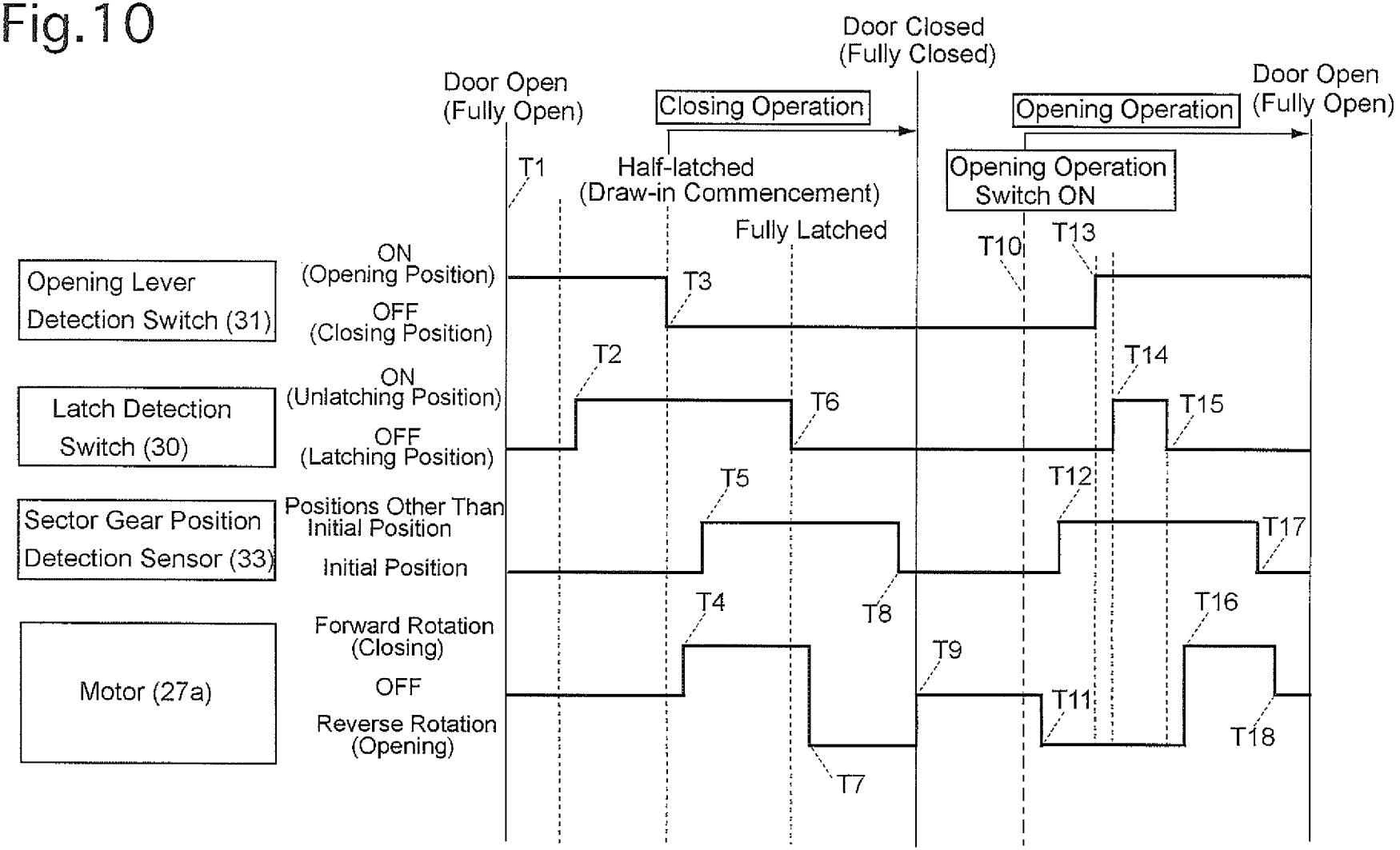
FIG. 10 is a timing chart showing a normal operating state of the door lock device.
Figure 11:
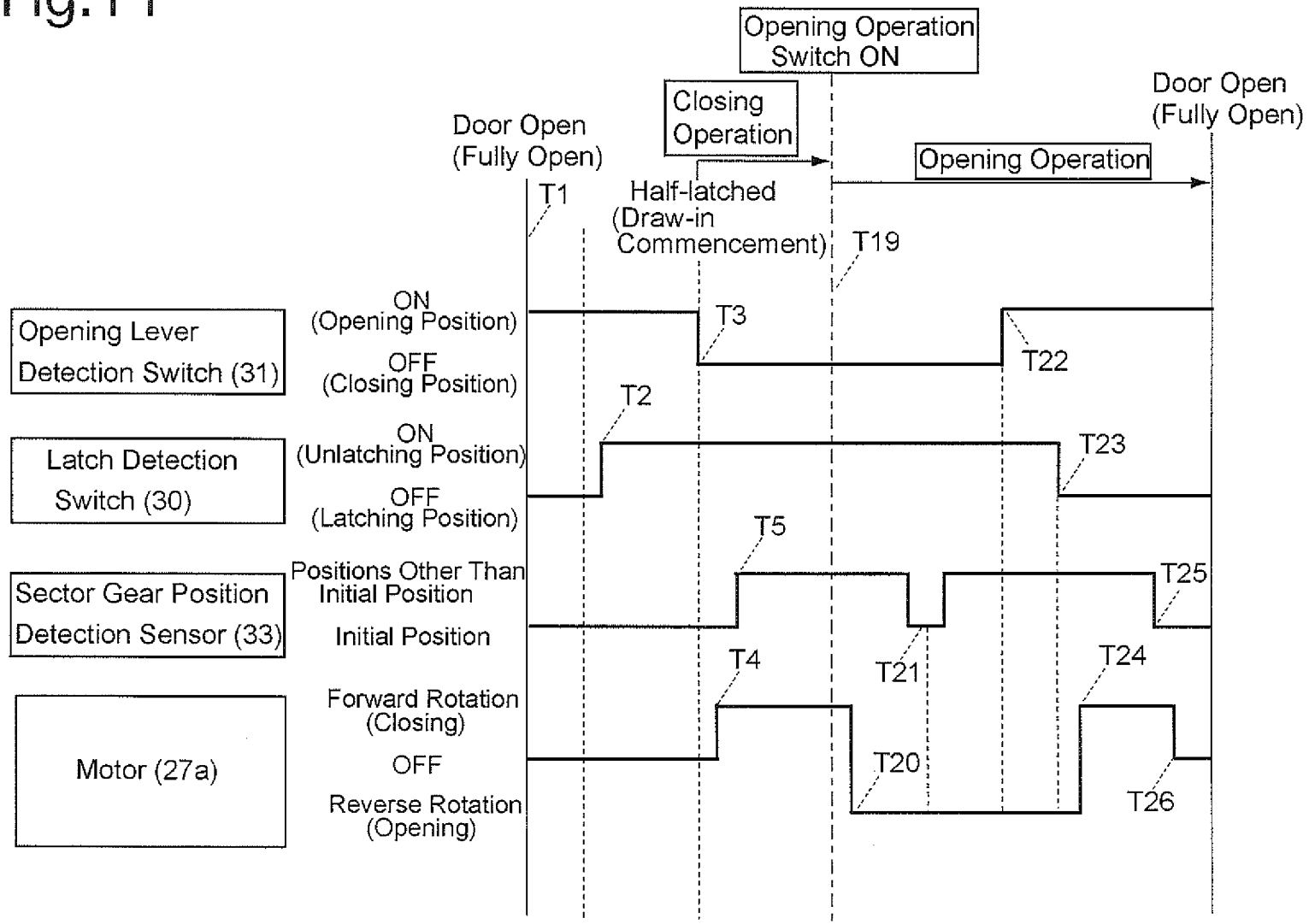
FIG. 11 is a timing chart in the case where an opening (closure-canceling) operation has been performed electrically at some point during the operation from the half-latched state to the fully-latched state.
Figure 12:
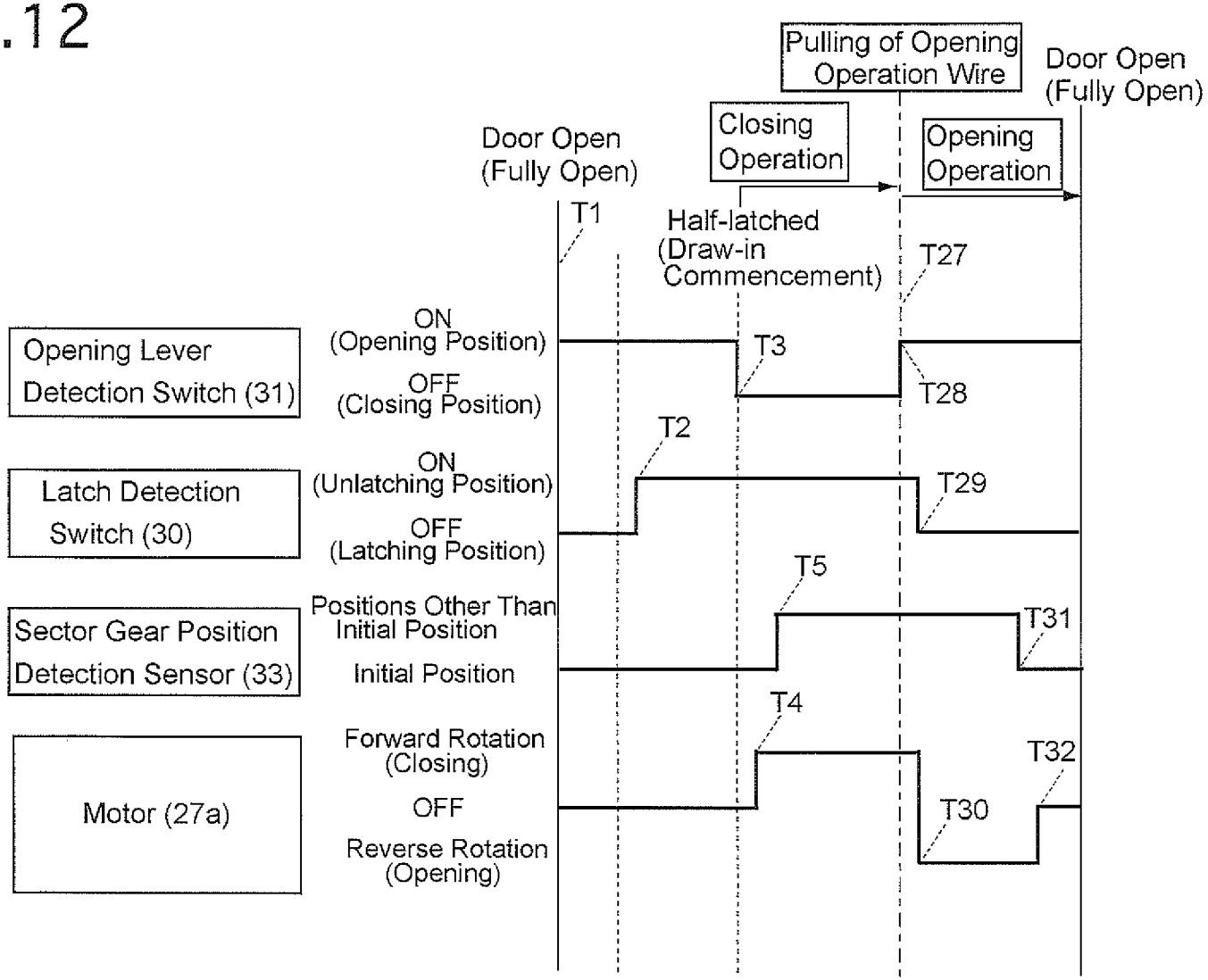
FIG. 12 is a timing chart in the case where the opening (closure-canceling) operation has been performed mechanically at some point during the operation from the half-latched state to the fully-latched state.

Operations of the door lock device 10 that has the above described structure will be hereinafter discussed with reference to FIG. 7 onwards. FIGS. 7 through 9 show mechanistic operations of the door lock device 10, and FIGS. 10 through 12 show timing charts showing the electrical control of the door lock device 10. F1, F2, F3 and F4 shown in the structural drawings represent the directions of spring biasing forces exerted on the hook 12, the latch 13, the closing lever 20 and the opening lever 23, respectively. The rotational directions of each component which will be discussed in the following descriptions are those in FIGS. 7 through 9. In addition, as for the driving direction of the motor 27*a*, the driving direction to close (lock) the door and the driving direction to unlock the door are referred to as the forward rotational direction and the reverse rotational direction, respectively.

First, normal operations shown in FIG. 10 will be discussed hereinafter. FIG. 7 shows the door lock device 10 in a trunk door opened (fully opened) state shown by T1 in the timing chart shown in FIG. 10. At this stage, the hook 12 is in the striker releasing position, in which the second leg portion 12*d* is positioned over the striker entry groove 11*a* while the first leg portion 12*c* is retracted from over the striker entry groove 11*a*, and the latch 13 is in the latching position, in which the latch 13 has been rotated in a direction to approach the hook 12. As described above, when the latch 13 is in the latching position, the latch 13 is in a state where the switch operating piece 13*f* does not press the switch leaf 30*a* of the latch detection switch 30, so that the latch detection switch 30 is in a switch-OFF state. The positions of the hook 12 and the latch 13 are maintained by the biasing force F1 of the torsion spring 16 and the biasing force F2 of the torsion spring 17. More specifically, the hook 12 is prevented from further rotating in the F1-direction by the engagement of a side surface of the first leg portion 12*c* with an upright wall 11*i* of the base plate 11, and the latch 13 is prevented from further rotating in the F2-direction by the engagement of the guide projection 13*b* with an end of the latch guide groove 11*e*. At this stage, the latch pressure projection 12*f* is in contact with the stepped portion 13*e*.

In the door-open state shown in FIG. 7, the closing lever 20 is in the draw-in releasing position, and the closing lever 20 is prevented from further rotating in the F3-direction of the extension spring 25 by the engagement of the control projection 21*c* of the interlinking lever 21, which is pivoted on the closing lever 20 via the pivot 22, with the lower end (wide-width end) of the interlinking-lever control hole 23*f* of the opening lever 23. At this stage, the biasing force F3 of the extension spring 25 that is exerted on the closing lever 20 acts in a direction to bring the control projection 21*c* of the interlinking lever 21 into pressing contact with the inner arc surface 23*f*1 of the interlinking-lever control hole 23*f*, while the interlinking lever 21 is prevented from rotating in a direction to approach the hook 12 by the engagement of the control projection 21*c* with the inner arc surface 23*f*1 to be held in the coupling disengaging position, in which the interlinking lever 21 cannot be coupled to the coupling projection 12*h* of the hook 12. In addition, the second arm 20*c* of the closing lever 20 in the draw-in releasing position is in contact with the closing lever operating pin 26*d*. This position corresponds to the initial position of the sector gear 26 that is detected by the sector gear position detection sensor 33. The opening lever 23 is prevented from rotating in the F4-direction of the extension spring 25 to be held in the opening position by the engagement of the rotation restriction wall 23*g* with the coupling projection 12*h* of the hook 12. As described above, when the opening lever 23 is in the opening position, the opening lever detection switch 31 is in an switch-ON state with the switch operating piece 23*e* pressing a switch leaf 31*a* of the opening lever detection switch 31. In addition, the ECU 32 detects a door-open state shown in FIG. 7 from a combination of an input signal indicating an OFF state of the latch detection switch 30 and an input signal indicating an ON state of the opening lever detection switch 31.

Upon the striker S entering the striker entry groove 11*a* and pressing the second leg portion 12*d* by a closing operation of the trunk door, the hook 12 is rotated in the counterclockwise direction toward a draw-in commencement position shown in FIG. 8 from the striker releasing position shown in FIG. 7 against the biasing force F1 of the torsion spring 16 while holding the striker S in the striker holding groove 12*b*. Thereupon, the latch pressure projection 12*f* of the hook 12 presses the stepped portion 13*e* of the latch 13 so that the latch 13 rotates in the clockwise direction to the unlatching position shown in FIG. 8 from the latching position shown in FIG. 7. This rotation of the latch 13 to the unlatching position causes the switch operating piece 13*f* to press the switch leaf 30*a*, thus causing the latch detection switch 30 to be turned ON from the OFF state (T2).

The rotation restriction wall 23*g* of the opening lever 23 has a predetermined length in the lengthwise direction of the second arm 23*c*, and when the hook 12 is in the range from the striker releasing position shown in FIG. 7 to a position immediately before reaching the draw-in commencement position shown in FIG. 8, the rotation restriction wall 23*g* is in contact with the coupling projection 12*h* of the hook 12 to prevent the opening lever 23 from rotating toward the closing position (clockwise direction), so that the opening lever 23 remains held in the opening position. Thereafter, upon the hook 12 reaching the draw-in commencement position shown in FIG. 8, the coupling projection 12*h* of the hook 12 is disengaged from the position against the rotation restriction wall 23*g* so that the prevention of rotation of the hook 12 is released, so that the opening lever 23 rotates to the closing position shown in FIG. 8 by the biasing force F4 of the extension spring 25 (T3). Upon the opening lever 23 rotating to the closing position, the prevention of movement of the control projection 21*c* of the interlinking lever 21 relative to the inner arc surface 23*f*1 of the interlinking-lever control hole 23*f* is released, which causes the interlinking lever 21 to rotate in the clockwise direction about the pivot 22 by the biasing force F3 of the extension spring 25 from the coupling disengaging position shown in FIG. 7 to the coupling position shown in FIG. 8. As a result, the coupling projection 12*h* of the hook 12 is held between the coupling recess 21*b* of the interlinking lever 21 and the recess 20*d* of the closing lever 20, so that the hook 12 and the closing lever 20 become integral with each other via the interlinking lever 21. This state corresponds to the half-latched state shown in FIG. 8. The rotation of the opening lever 23 to the closing position causes the switch operating piece 23*e* to stop pressing the switch leaf 31*a*, thus causing the opening lever detection switch 31 to be turned OFF from the ON state (T3). Thereafter, the ECU 32 detects the half-latched state shown in FIG. 8 from a combination of an input signal indicating an ON state of the latch detection switch 30 and an input signal indicating an OFF state of the opening lever detection switch 31.

The interlinking lever 21 and the opening lever 23 are both rotated in the clockwise direction when the door lock device 10 moves from the door fully opened state shown in FIG. 7 to the half-latched state shown in FIG. 8; however, the second arm 23*c* of the opening lever 23 in the vicinity of the end thereof is displaced by a greater amount than that of the interlinking lever 21 due to the difference in lever ratio therebetween. Therefore, the control projection 21*c* of the interlinking lever 21 relatively changes the position thereof in the interlinking-lever control hole 23*f* in the widthwise direction thereof to change the state of the door lock device 10 from the state (shown in FIG. 7) in which the control projection 21*c* is in contact with the inner arc surface 23*f*1 to the state (shown in FIG. 8) in which the control projection 21*c* is in contact with the outer arc surface 23*f*2. Additionally, in this state, the interlinking lever 21 is prevented from rotating toward the coupling disengaging position by the engagement between the control projection 21*c* and the outer arc surface 23*f*2.

Upon the detection of the half-latched state, the ECU 32 drives the motor 27*a* of the motor unit 27 in the forward direction (T4). Thereupon, due to the engagement between the pinion 27*b* and the gear portion 26*b*, the sector gear 26 is rotated in the clockwise direction with respect to FIG. 8 (T5), and this rotation of the sector gear 26 causes the closing lever operating pin 26*d* to press the second arm 20*c* to thereby rotate the closing lever 20 in the counterclockwise direction from the draw-in releasing position shown in FIG. 8 to the draw-in position shown in FIG. 9. This also causes the hook 12, which is in integral operation with the closing lever 20 via the interlinking lever 21, to rotate in the counterclockwise direction from the draw-in commencement position shown in FIG. 8 to the striker holding position shown in FIG. 9, so that the striker S is drawn deeply into the striker entry groove 11*a* by the striker holding groove 12*b* of the hook 12. At this stage, the interlinking lever 21 moves integrally with the closing lever 20 about the pivot 14 while making the control projection 21*c* slide on the outer arc surface 23*f*2 of the interlinking-lever control hole 23*f* with the coupling recess 21*b* and the coupling projection 12*h* remaining engaged with each other. Namely, the outer arc surface 23*f*2 is a circular arc surface formed along the moving (rotating) path of the control projection 21*c* about the pivot 14 when the opening lever 23 is in the closing position and also when the interlinking lever 21 is in the coupling position, in which the interlinking lever 21 is engaged with the coupling projection 12*h*. Additionally, during the time the opening lever 23 is held in the closing position, the interlinking lever 21 is prevented from rotating (rotating on the pivot 22) in a direction (toward the coupling disengaging position) to release the engagement between the coupling recess 21*b* and the coupling projection 12*h* by the engagement between the outer arc surface 23*f*2 and the control projection 21*c*. In other words, the outer arc surface 23*f*2 functions as a guide surface which determines the path of the rotational movement of the interlinking lever 21 during the closing operation of the trunk door from the half-latched state.

During the rotation of the combination of the hook 12 and the closing lever 20 in the draw-in direction of the striker S from the half-latched state shown in FIG. 8, the convex-shaped circular arc surface 12*g* that is formed at the end of the second leg portion 12*d* comes in sliding contact with the concave-shaped circular arc surface 13*d* of the latch 13, and the latch 13 is held in the unlatching position against the biasing force F2 of the torsion spring 17 in a manner similar to the case of the half-latched state shown in FIG. 8. During this stage, the opening lever 23 is also held in the closing position in a manner similar to the case in the half-latched state. Namely, a state where the latch detection switch 30 and the opening lever detection switch 31 are ON and OFF, respectively, continues. Thereafter, a rotation of the hook 12 to the striker holding position shown in FIG. 9 causes the convex-shaped circular arc surface 12*g* to escape upward from a position facing the concave-shaped circular arc surface 13*d* to thereby release the prevention of rotation of the latch 13 relative to the hook 12, which causes the latch 13 to rotate toward the latching position (in the counterclockwise direction) from the unlatching position by the biasing force F2 of the torsion spring 17 so that the rotation-restriction stepped portion 13*c* is engaged with the latch-engaging stepped portion 12*e* as shown in FIG. 9. Due to this engagement between the rotation-restriction stepped portion 13*c* and the latch-engaging stepped portion 12*e*, the hook 12 is prevented from rotating in the direction toward the striker releasing position, so that the door lock device 10 comes into the fully-latched state (the door fully-closed state), in which the striker S is completely held in the inner part of the striker entry groove 11*a*. The counterclockwise rotation of the latch 13 when the rotation-restriction stepped portion 13*c* is brought into engagement with the latch-engaging stepped portion 12*e* causes the switch operating piece 13*f* to stop pressing the switch leaf 30*a*, thus causing the latch detection switch 30 to be turned OFF from the ON state (T6). Namely, each of the latch detection switch 30 and the opening lever detection switch 31 is turned OFF, thereby the fully-latched state being detected.

Upon the detection of the fully-latched state, the ECU 32 continues to drive the motor 27*a* in the forward direction by a predetermined overstroke amount and thereafter drives the motor 27*a* reversely in the door opening direction in order to ensure a latched state (T7). This reverse driving of the motor 27*a* is for returning the sector gear 26 which has been rotated to the position shown in FIG. 9 by the closing operation to the initial position shown in FIG. 7, and the motor 27*a* is stopped (T9) upon the sector gear position detection sensor 33 detecting that the sector gear 26 has returned to the initial position thereof (T9). In this motor stopped state, the closing lever operating pin 26*d* is disengaged from the first arm 20*b*, so that the pressure force on the closing lever 20 from the sector gear 26 is released. However, as described above, the hook 12 is prevented from rotating in the clockwise direction with respect to FIG. 9 (in the direction toward the striker releasing position) due to the engagement thereof with the latch 13, and the closing lever 20 which is integrally operating with the hook 12 is also prevented from rotating in the clockwise direction (in the direction toward the draw-in releasing position) against the biasing force F4 of the extension spring 25. In other words, the fully-latched state is maintained.

Upon the opening operation switch 34 being turned ON in the fully-latched state (T10), the motor 27*a* is driven in reverse (T11) to rotate the sector gear 26 in the counterclockwise direction from the initial position shown in FIG. 7 (T12). Thereupon, the opening lever operating piece 26*c* presses the gear contact portion 23*h*, which causes the opening lever 23 to rotate counterclockwise from the closing position shown in FIG. 9 toward the opening position against the biasing force F4 of the extension spring 25 so that the opening lever detection switch 31 is turned ON from the OFF state (T13). This counterclockwise rotation of the opening lever 23 causes the inner arc surface 23*f*1 of the interlinking-lever control hole 23*f* to press the control projection 21*c*, thus causing the interlinking lever 21 to rotate (rotate on its axis) counterclockwise (toward the coupling disengaging position) about the pivot 22. As can be understood from FIG. 9, in the fully-latched state, the control projection 21*c* of the interlinking lever 21 is positioned in an upper section of the interlinking-lever control hole 23*f* that is narrow in width, so that the clearance between the control projection 21*c* and the inner arc surface 23*f*1 is small, and accordingly, the time lag from the moment the opening lever 23 starts rotating toward the opening position to the moment the inner arc surface 23*f*1 presses the control projection 21*c* is extremely small. This rotation of the interlinking lever 21 causes the engagement between the coupling recess 21*b* and the coupling projection 12*h* to be released to thereby decouple the hook 12 and the closing lever 20 from each other. In addition, the latch pressure projection 21*d* of the interlinking lever 21 presses the pressed piece 13*g* of the latch 13 to rotate the latch 13 in the clockwise direction from the latching position to the unlatching position against the biasing force F2 of the torsion spring 17 (T14).

This rotation of the latch 13 to the unlatching position causes the engagement between the rotation-restriction stepped portion 13*c* and the latch-engaging stepped portion 12*e*, i.e., the prevention of rotation of the hook 12, to be released, which causes the hook 12 to rotate toward the striker releasing position shown in FIG. 7 from the striker holding position shown in FIG. 9 by the biasing force F1 of the torsion spring 16. The closing lever 20, the engagement thereof with the hook 12 having being released, is also rotated clockwise toward the draw-in releasing position shown in FIGS. 7 and 8 from the draw-in position shown in FIG. 9 by the biasing force F4 of the extension spring 25; in accordance with this rotation, the control projection 21*c* of the interlinking lever 21 moves in the interlinking-lever control hole 23*f* toward the lower end (wide-width end) thereof while sliding on the inner arc surface 23*f*1. Namely, the inner arc surface 23*f*1 of the interlinking-lever control hole 23*f* is a circular arc surface formed along the moving (rotating) path of the control projection 21*c* about the pivot 14 when the opening lever 23 is in the opening position and also when the interlinking lever 21 is in the coupling disengaging position, in which the interlinking lever 21 releases the engagement between the coupling recess 21*b* and the coupling projection 12*h*. Additionally, during the time the opening lever 23 is held in the opening position, the interlinking lever 21 is prevented from rotating (rotating on the pivot 22) in a direction (toward the coupling position) to make the coupling recess 21*b* and the coupling projection 12*h* re-engaged with each other by the engagement between the inner arc surface 23*f*1 and the control projection 21*c*. In other words, the inner arc surface 23*f*1 functions as a guide surface which determines the path of the rotational movement of the interlinking lever 21 during the opening operation of the trunk door from the fully-latched state.

Upon the interlinking lever 21 moving downward by a predetermined amount of movement following the rotation of the closing lever 20 toward the draw-in releasing position, the pressure of the latch pressure projection 21*d* of the interlinking lever 21 against the pressed piece 13*g* of the latch 13 in a direction toward the unlatching position is released. However, during the time until the hook 12 reaches the striker releasing position shown in FIG. 7 from the striker holding position shown in FIG. 9, the convex-shaped circular arc surface 12*g* of the second leg portion 12*d* of the hook 12 presses the concave-shaped circular arc surface 13*d* of the latch 13 so that the latch 13 continues to be held in the unlatching position against the biasing force F2 of the torsion spring 17. More specifically, the amount of rotation of the closing lever 20 from the draw-in position (FIG. 9) to the draw-in releasing position (FIG. 8) is substantially the same as the amount of rotation of the hook 12 from the striker holding position (FIG. 9) to the draw-in commencement position (FIG. 8), and when performing the opening operation, the pressure of the interlinking lever 21 on the latch 13 toward the unlatching position is released at a stage before the closing lever 20 reaches the draw-in releasing position shown in FIG. 8. On the other hand, the pressure of the second leg portion 12*d* of the hook 12 on the latch 13 in a direction toward the unlatching position continues for a longer period of time than the pressure of the interlinking lever 21 on the latch 13, and it is not until the engagement between the convex-shaped circular arc surface 12*g* and the concave-shaped circular arc surface 13*d* is released, upon the latch pressure projection 12*f* moving over the stepped portion 13*e* of the latch 13 after the hook 12 reaches the striker releasing position (FIG. 7), that the latch 13 is allowed to rotate to the latching position. Thereafter, the latch 13 rotates and returns to the latching position from the unlatching position by the biasing force F2 of the torsion spring 17 (T15) after the aforementioned allowance of rotation of the latch 13 takes place. Namely, the aforementioned signals representing a door-open state that respectively indicate an OFF state of the latch detection switch 30 and an ON state of the opening lever detection switch 31 are not input until the hook 12 reaches the striker releasing position.

Upon the detection of the door-open state, the ECU continues to drive the motor 27*a* in the reverse direction by a predetermined overstroke amount and thereafter drives the motor 27*a* forwardly in the door closing direction in order to ensure a latch released state (T16). This forward driving of the motor 27*a* is for returning the sector gear 26, which has been rotated counterclockwise from the initial position shown in FIG. 7 when performing the opening operation, to the initial position, and the motor 27*a* is stopped (T18) upon the sector gear position detection sensor 33 detecting that the sector gear 26 has returned to the initial position thereof (T17), so that the door lock device 10 returns to the door-open state shown in FIG. 7.

FIG. 11 shows a process performed in the case where the opening (closure-canceling) operation is performed by an operation of the opening operation switch 34 during the time the door lock device 10 moves from the half-latched state shown in FIG. 8 until coming into the fully-latched state shown in FIG. 9. Operations are the same as those of the above described normal operations until when the motor 27*a* is driven forward, in response to an input of the signal representing the half-latched state (in which the latch detection switch 30 is ON and the opening lever detection switch 31 is OFF), to rotate the sector gear 26 clockwise with respect to FIG. 8 to thereby press and rotate the closing lever 20 toward the draw-in position (T5). At this stage, upon the opening operation switch 34 being turned ON before the door lock device 10 comes into the fully-latched state (T19), the ECU 32 switches the driving direction of the motor 27*a* from forward to reverse (T20). Thereupon, the sector gear 26 stops pressing the closing lever 20 via the closing lever operating pin 26*d*. This causes the combination of the hook 12 and the closing lever 20 to return to the half-latched state shown in FIG. 8 by the biasing force F1 of the torsion spring 16 and the biasing force F3 of the extension spring 25. Although the sector gear 26 temporarily returns to the initial position (T21), the sector gear 26 continues to be driven in the reverse direction without the motor 27*a* being stopped. Thereupon, the opening lever operating piece 26*c* of the sector gear 26 presses the gear contact portion 23*h* to rotate the opening lever 23 counterclockwise toward the opening position from the closing position against the biasing force F4 of the extension spring 25, and this operation is detected by the opening lever detection switch 31 (T22).

When the opening lever 23 rotates to the opening position in the half-latched state shown in FIG. 8, a predetermined idle running time (corresponding to the section in which the contact point of the control projection 21*c* is switched from the outer arc surface 23*f*2 to the inner arc surface 23*f*1) elapses, and thereafter, the inner arc surface 23*f*1 of the interlinking-lever control hole 23*f* presses the control projection 21*c*, which causes the interlinking lever 21 to rotate from the coupling position, in which the interlinking lever 21 is engaged with the coupling projection 12*h* of the hook 12, to the coupling-disengaging position, in which the interlinking lever 21 is disengaged from the coupling projection 12*h* of the hook 12. This causes the engagement between the hook 12 and the closing lever 20 to be released, thus causing the hook 12 to solely rotate toward the striker releasing position shown in FIG. 7 from the draw-in commencement position shown in FIG. 8 by the biasing force F1 of the torsion spring 16. Upon the hook 12 reaching the striker releasing position, the pressure of the convex-shaped circular arc surface 12*g* of the second leg portion 12*d* against the concave-shaped circular arc surface 13*d* is released, so that the latch 13 rotates from the latching position to the unlatching position, and this operation is detected by the latch detection switch 30 (T23). This produces a signal indicating the door-open state, in which the latch detection switch 30 is OFF and the opening lever detection switch 31 is ON. Upon input of this signal, similar to the case when normal operations are performed, the motor 27*a* is driven forward after being driven reverse continuously by a predetermined amount of overstroke (T24) to return the sector gear 26 to the initial position (T25) and subsequently the door lock device 10 returns to the door-open state shown in FIG. 7 by stopping the motor 27*a* (T26).

FIG. 12 shows a process performed in the case where a mechanical opening (closure-canceling) operation is performed via the opening operation wire W instead of the opening operation switch 34 during the time the door lock device 10 moves from the half-latched state shown in FIG. 8 until coming into the fully-latched state shown in FIG. 9. Operations are the same as those of the above described normal operations until when the motor 27*a* is driven forward upon detection of the signal representing the half-latched state (in which the latch detection switch 30 is ON and the opening lever detection switch 31 is OFF) to rotate the sector gear 26 clockwise with respect to FIG. 8 to thereby press and rotate the closing lever 20 (T5). At this stage, the opening operation wire W is pulled by operating the aforementioned key apparatus or emergency release handle (T27) causing a force to be applied on the wire hooking portion 23*d* pulls the wire hooking portion 23*d* upward, thus causing the opening lever 23 to rotate from the closing position to the opening position, so that the opening lever detection switch 31 is switched from the OFF state (closing position) to the ON state (opening position) (T28). This rotation of the opening lever 23 causes the inner arc surface 23*f*1 of the interlinking-lever control hole 23*f* to press the control projection 21*c* of the interlinking lever 21, thus causing the interlinking lever 21 to rotate (rotate on its axis) counterclockwise about the pivot 22 to thereby be disengaged from the coupling projection 12*h* of the hook 12. Accordingly, the hook 12, the engagement thereof with the closing lever 20 being released, is rotated toward the striker releasing position shown in FIG. 7 by the biasing force F1 of the torsion spring 16. Subsequently, upon the hook 12 reaching the striker releasing position, the pressure of the convex-shaped circular arc surface 12*g* of the second leg portion 12*d* on the concave-shaped circular arc surface 13*d* is released, which causes the latch 13 to rotate from the latching position to the unlatching position, so that the latch detection switch 30 is turned OFF from the ON state (T29). The door-open state is detected from a combination of this OFF state of the latch detection switch 30 and the ON state of the opening lever detection switch 31. Upon this detection of the door-open state, the ECU 32 switches the driving direction of the motor 27*a* from forward to reverse (T30), which causes the sector gear 26 to rotate toward the initial position from the position where the sector gear 26 presses the closing lever 20. Upon the sector gear position detection sensor 33 detecting that the sector gear 26 returns to the initial position thereof (T31), the motor 27*a* is stopped (T32); consequently, the door lock device 10 returns to the door-open state shown in FIG. 7.

As described above, in the present embodiment of the door lock device 10, the latch 13 is made to return to the latching position from the unlatching position upon the hook 12 reaching the striker releasing position, and it is detected that the door is open (latch release/lock release) by referring to this returning operation. This configuration makes it possible to detect the door-open state without directly detecting the position of the hook 12, i.e., even if there is no sufficient space for the installation of a detector around the hook 12. In addition, in the door lock device 10, the components thereof, including the latch detection switch 30 and the opening lever detection switch 31 that serve as detectors, are arranged at predetermined positions on the base plate 11 as a unit, and accordingly, the door lock device 10 is easy to handle and requires no troublesome adjustment when installed to a vehicle. Additionally, since the latch 13 does not return to the latching position until the hook 12 reaches the striker releasing position, i.e., until the door lock is fully released, even in the case where the door lock device 10 stops during the opening operation due to some error, there is no possibility of this condition being mistakenly detected as a door open condition. For instance, if the signals indicating the door-open state (a combination of a signal indicating an OFF state of the latch detection switch 30 and a signal indicating an ON state of the opening lever detection switch 31) are not input within a predetermined period of time during the opening operation, this condition is determined as an error in the opening operation, so that safety can be secured by performing an appropriate process such as a motor stopping process or a warning issuing process.

Additionally, the latch controller that achieves the above described operations of the latch 13 is configured from a structure having excellent space utilization which includes the small interlinking lever 21 that is pivoted on the closing lever 20 and the interlinking-lever control hole 23*f* that is formed in the opening lever 23, etc., thus being capable of avoiding an increase in size of the door lock device 10.

Although the present invention has been described based on the illustrated embodiment, the present invention is not limited solely to this particular embodiment. For instance, although the illustrated embodiment is a door lock device of a trunk door, the present invention can also be applied to a door other than a trunk door.

INDUSTRIAL APPLICABILITY

The present invention is useful in a door lock device for locking and unlocking a vehicle door and applicable especially in the case of detecting a door-open state with high precision without being constrained by the space around the hook and achieving an improvement in assembly work.

EXPLANATIONS OF LETTERS OR NUMERALS

10 Door Lock Device
11 Base Plate
11*a* Striker Entry Groove
12 Hook
12*b* Striker Holding Groove
12*e* Latch-Engaging Stepped Portion (Engaging Portion)
12*f* Latch Pressure Projection (Latch Controller)
12*g* Circular Arc Surface (Latch Controller/latch Holder)
12*h* Coupling Projection (Opening Lever Holder)
13 Latch
13*c* Rotation-Restriction Stepped Portion
13*d* Circular Arc Surface (Latch Controller/Latch Holder)
13*e* Stepped Portion (Latch Controller)
13*f* Switch Operating Piece
13*g* Pressed Piece (Latch Controller/Interlinking-Lever Linkup Portion)
16 Torsion Spring
17 Torsion Spring (latch Biaser)
20 Closing Lever
20*b* First Arm
20*c* Second Arm
20*d* Recess
21 Interlinking Lever (Latch Controller)
21*b* Coupling Recess
21*c* Control Projection
21*d* Latch Pressure Projection
23 Opening Lever
23*b* First Arm
23*c* Second Arm (Arm Portion)
23*e* Switch Operating Piece
23*f* Interlinking-Lever Control Hole (Latch Controller)
23*f*1 Inner Arc Surface (Projection Operating Surface)
23*f*2 Outer Arc Surface (Opposed Guide Surface)
25 Extension Spring (Closing Lever Biaser/Opening Lever Biaser)
26 Sector Gear (Motor-Operated Driving Mechanism)
26*c* Opening Lever Operating Piece
26*d* Closing Lever Operating Pin
27 Motor Unit
27*a* Motor
27*b* Pinion
30 Latch Detection Switch (Detector/First Switch)
31 Opening Lever Detection Switch (Detector/Second Switch)
32 Electronic Control Unit (ECU)
33 Sector Gear Position Detection Sensor
34 Opening Operation Switch
S Striker
W Opening Operation Wire

The invention claimed is:

1. A door lock device for holding a door in a fully-closed state, said door being capable of being opened and closed relative to a vehicle body, said door locking apparatus comprising:

a base plate and a striker which are installed to one and the other of said door and said vehicle body;

a hook which is supported by said base plate to be rotatable between a striker holding position for holding said striker and a striker releasing position for releasing said striker, said hook being biased toward said striker releasing position;

a latch which is supported by said base plate to be rotatable between a latching position at which said latch advances onto a rotating path of an engaging portion provided on said hook and an unlatching position at which said latch withdraws from said rotating path of said engaging portion of said hook;

an opening lever which includes an arm portion that generally overlays said latch, is rotatably supported by said base plate thereon, and rotates between an opening position at which said arm portion is displaced toward said unlatching position of said latch and a closing position at which said arm portion is displaced toward said latching position of said latch;

a latch controller which holds said latch in said latching position in each of a door-open state in which said hook is positioned in said striker releasing position and a door fully-closed state in which said hook is positioned in said striker holding position; prevents said hook from rotating toward said striker releasing position by engagement between said engaging portion of said hook and said latch in said door fully-closed state; and, when said latch controller performs a door opening operation from said door fully-closed state, makes said latch return to said latching position upon said hook reaching said striker releasing position after engagement between said latch and said hook has been released by causing said latch to rotate toward said unlatching position from said latching position in accordance with the rotation of said open lever from said closing position to said opening position;

a latch detector for detecting said latching position of said latch and said unlatching position thereof;

an open lever detector for detecting said opening position of said open lever and said closing position thereof; and a detector for detecting, by a combination of said latch detector and said open lever detector, said door-open state, a half-latching state in which said hook temporarily holds said striker, and said door fully-closed state.

2. The door lock device according to claim 1, comprising:

a closing lever which is supported by said base plate thereon to be rotatable coaxially with said hook and rotates between a draw-in position, at which said closing lever is positioned toward said striker holding position of said hook, and a draw-in releasing position, at which said closing lever is positioned toward said striker releasing position of said hook;

a closing lever biaser which biases said closing lever toward said draw-in releasing position; and a motor-operated driving mechanism, provided with a motor which rotates said closing lever to said draw-in position by a forward rotation of said motor and rotates said opening lever to said opening position by a reverse rotation of said motor, wherein said latch controller comprises:

an interlinking lever which is pivoted on said closing lever and rotatable between a coupling position at which said closing lever and said hook are coupled so as to integrally operate via said interlinking lever and a coupling disengaging position at which the coupling state between said closing lever and said hook is released by said interlinking lever to allow said closing lever and said hook to rotate relative to each other;

a control hole which is formed in said arm portion of said opening lever, allows a control projection which is provided on said interlinking lever to engage in said control hole, and transmits a force to said control projection by a rotation of said opening lever from said closing position to said opening position to make said interlinking lever move from said coupling position to said coupling disengaging position;

a latch biaser which biases said latch toward said latching position;

an interlinking-lever linkup portion which is provided on said latch and receives a force acting in a direction toward said unlatching position by a rotation of said interlinking lever from said coupling position to said coupling disengaging position; and latch holders which are provided between said hook and said latch, contact each other to hold said latch in said unlatching position against said latch biaser when said hook is positioned at some point between said striker holding position and said striker releasing position, and are released from contact with each other to allow said latch to move to said latching position when said hook is positioned in said striker holding position and when said hook is positioned in said striker releasing position, wherein, when said opening lever is rotated from said closing position to said opening position in said door fully-closed state, said interlinking lever is rotated from said coupling position to said coupling disengaging position by a projection operating surface of said opening lever in said control hole, and after said latch is rotated from said latching position to said unlatching position via said interlinking-lever linkup portion, said interlinking lever retracts from an interlinked position with respect to said latch via a rotation of said closing lever from said draw-in position to said draw-in releasing position by a biasing force of said closing lever biaser; said hook rotates from said striker holding position to said striker releasing position by the movement of said latch to said unlatching position, and holds said latch in said unlatching position via said latch holder after an operation of said latch performed by said interlinking lever is canceled; and, upon said hook reaching said striker releasing position, said holding of said latch in said unlatching position by said latch holder is canceled, so that said latch rotates to said latching position by a biasing force of said latch biaser.

3. The door lock device according to claim 2, comprising:

an opening lever biaser which biases said opening lever toward said closing position; and opening lever holders which are provided between said hook and said opening lever, and prevent said opening lever from rotating toward said closing position from said opening position when said hook is positioned in said striker releasing position, wherein, when said door is closed from an open state thereof, upon said hook reaching a draw-in commencement position, in which said hook becomes said half-latching state, at some point during rotation of said hook from said striker releasing position toward said striker holding position, at said half-latching state, the holding state of said opening lever by said opening lever holders is canceled so that said opening lever rotates from said opening position to said closing position by a biasing force of said opening lever biaser while said interlinking lever rotates from said coupling disengaging position to said coupling position by said biasing force of said closing lever biaser to be coupled to said hook.

4. The door lock device according to claim 3, wherein said projection operating surface of said opening lever in said control hole includes a circular arc surface which is formed along a moving path of said control projection that accompanies rotation of said closing lever when said opening lever is in said opening position and also when said interlinking lever is in said coupling disengaging position, wherein said control hole of said opening lever includes an opposed guide surface formed from a circular arc surface which is opposed to said projection operating surface and formed along a moving path of said control projection that accompanies rotation of said closing lever when said opening lever is in said closing position and also when said interlinking lever is in said coupling position, wherein said control hole is an elongated hole which gradually increases a distance between said projection operating surface and said opposed guide surface in a direction toward said draw-in releasing position from said draw-in position of said closing lever.

5. The door lock device according to claim 4, wherein, when said door is opened from said fully-closed state thereof, said control projection of said interlinking lever held in said coupling disengaging position moves along said projection operating surface in said control hole of said opening lever positioned in said opening position, and said closing lever is locked in said draw-in releasing position by engagement of said control projection with an end of said control hole on a wide-width side thereof, and wherein, when said door is closed from said open state thereof, said rotation of said opening lever from said opening position to said closing position upon said hook reaching said draw-in commencement position from said striker releasing position causes said control projection of said interlinking lever to move from said projection operating surface side toward said opposed guide surface side, and subsequently a rotation of said closing lever from said draw-in releasing position to said draw-in position causes said control projection of said interlinking lever to move toward an end of said control hole on a narrow-width side thereof along said opposed guide surface of said opening lever held in said closing position.

6. The door lock device according to claim 1, wherein said detector is arranged to detect said door-open state by combined signals of said opening position of said opening lever and said latching position of said latch, is arranged to detect said door fully-closed state by combined signals of said closing position of said opening lever and said latching position of said latch, and is arranged to detect said half-latching state by combined signals of said closing position of said opening lever and said unlatching position of said latch.

7. The door lock device according to claim 1, wherein said latch detector comprises a first switch for detecting said latching position and said unlatching position of said latch; and said open lever detector comprises a second switch for detecting said opening position and said closing position of said opening lever.

* * * * *